United States Patent [19]

Walsh

[11] 4,380,219

[45] Apr. 19, 1983

[54] VALVE DISABLING MECHANISM

[75] Inventor: Michael M. Walsh, Northville, Mich.

[73] Assignee: Eaton Corporation, Cleveland, Ohio

[21] Appl. No.: 578,295

[22] Filed: May 16, 1975

[51] Int. Cl.[3] ..... F02D 13/06

[52] U.S. Cl. ..... 123/198 F; 123/90.16; 123/90.32; 123/90.41

[58] Field of Search ..... 123/198 R, 198 F, 1 R, 123/DIG. 1, DIG. 7, 90.32, 90.41, 90.43, 90.15, 90.16, 90.17; 251/77, 78

[56] References Cited

U.S. PATENT DOCUMENTS

| | | | |
|---|---|---|---|
| 794,683 | 7/1905 | Riotte | 123/198 F |
| 948,248 | 2/1910 | Reaugl | 123/198 F |
| 1,331,787 | 2/1920 | Schatter | 123/198 F |
| 1,350,989 | 8/1920 | Cox | 123/198 F |
| 1,358,459 | 11/1920 | Pache | 123/198 F |
| 1,797,105 | 3/1931 | Shoblom | 123/90.41 X |
| 2,392,933 | 1/1946 | Mallory | 123/198 F |
| 2,528,983 | 11/1950 | Weiss | 123/198 F |
| 2,808,818 | 10/1957 | Sampietro | 123/90.43 |
| 2,853,984 | 9/1958 | Sampietro | 123/90.43 |
| 2,863,430 | 12/1958 | Sampietro | 123/90.43 |
| 3,009,450 | 11/1961 | Engemann | 123/90.43 |
| 3,147,745 | 9/1964 | Kilgore | 123/90.43 |
| 3,169,515 | 2/1965 | Kilgore et al. | 123/90.43 |
| 3,964,455 | 6/1976 | Brown | 123/90.43 |

FOREIGN PATENT DOCUMENTS

| | | | |
|---|---|---|---|
| 864080 | 4/1941 | France | 123/198 F |

*Primary Examiner*—Ira S. Lazarus

*Attorney, Agent, or Firm*—C. H. Grace; P. S. Rulon; F. M. Sajovec

[57] ABSTRACT

A valve disabling and switch mechanism for a multi-cylinder internal combustion engine is disclosed. One embodiment of the disabling mechanism is for an individually pivoted rocker arm; this disabling mechanism includes means which allow sliding movement of the rocker arm fulcrum to disable the valve, resilient means which ineffectively oppose sliding movement of the fulcrum, and stop means which prevent feedback of the force from the resilient means to the cam when the engine cam is in the dwell position. The switch mechanism is a spring loaded toggle switch which applies a force for switching the disabling mechanism between the disabling and non-disabling positions with a force effective to move the disabling mechanism only when the cam is in the dwell position. A second embodiment of the disabling mechanism is for a rocker arm pivoted about a rocker shaft; this disabling mechanism includes a two member rocker arm and includes the ineffective resilient means and the stop means.

36 Claims, 9 Drawing Figures

VALVE DISABLING MECHANISM

BACKGROUND OF THE INVENTION

1. Field of the Invention

The invention relates to a mechanism for varying the opening of a valve actuated by a rocker arm and more specifically to deactivating selected cylinders of an Otto Cycle Engine with such a mechanism.

2. Description of the Prior Art

The concept of deactivating selected cylinders of an engine by disabling the valves associated with the selected cylinders is old. When this concept is applied to an Otto Cycle Engine, pumping or throttling losses are reduced, thereby improving engine efficiency during part throttle operation. Mechanisms proposed in the prior art to carry out the concept have had some disadvantages, e.g., they were either expensive, unreliable, required extensive engine modifications, could not be switched on or off during engine operation, or caused clashing of components in the valve drive train due to the mechanism either physically separating valve train components or reducing forces tending to keep connecting components in driving contact.

SUMMARY OF THE INVENTION

An object of this invention is to provide a simple, low cost, and reliable valve disabling mechanism associated with a rocker arm driven by a drive means.

Another object of this invention is to provide such a valve disabling mechanism which includes resilient force means for preventing clashing between the drive means and the rocker arm when the disabling mechanism is in the disabling position.

Another object of this invention is to provide such a valve disabling mechanism which prevents feedback of the clash preventing force into the drive means when the rocker arm is not being moved by the drive means.

Another object of this invention is to provide a valve disabling mechanism for a machine and a switch mechanism for switching the disabling mechanism between disabling and non-disabling positions during operation of the machine.

The valve disabling mechanism of this invention is associated with a rocker arm in a machine, such as a multi-cylinder internal combustion engine; one end of the rocker arm is in driving contact with a valve and normally opens the valve a predetermined distance in response to the drive means, such as a cam, moving the other end of the rocker arm a given distance.

According to a feature of this invention the disabling mechanism allows the drive means to move the other end of the rocker arm the given distance without a corresponding or predetermined opening of valve and a resilient means applies a force for maintaining the other end of the rocker arm in driving contact with the drive means.

According to another feature of the invention, stop means prevent the drive means being subjected to the resilient force when the drive means is not moving the rocker arm.

According to another feature of the invention, a selectively operative switching mechanism applies a force for repositioning the disabling mechanism from the disabling position to the nondisabling position and vice versa and the force is effective to reposition the disabling mechanism only when the driving means is inactive.

BRIEF DESCRIPTION OF THE DRAWINGS

The preferred embodiment of the invention is shown in the accompanying drawings in which.

Figure 1:
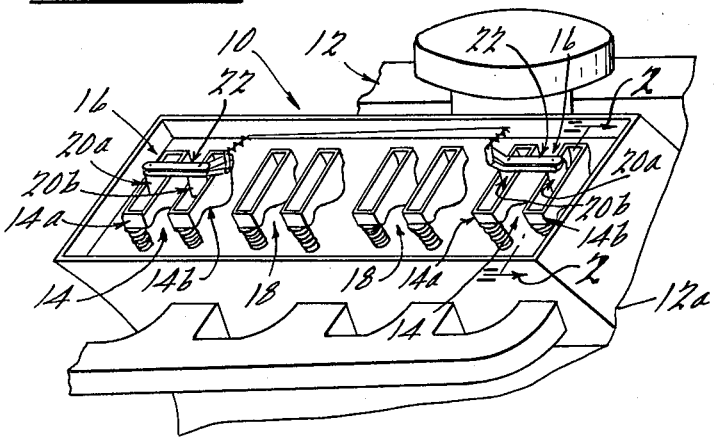
FIG. 1 is a partial view of a V-8 engine equipped with the valve disabling and switch mechanisms.
Figure 6:
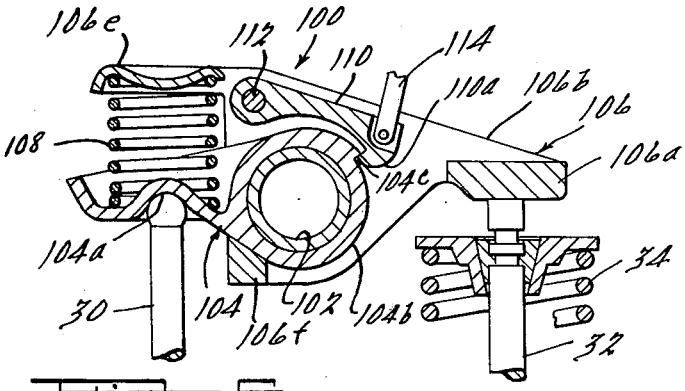
Figure 7:
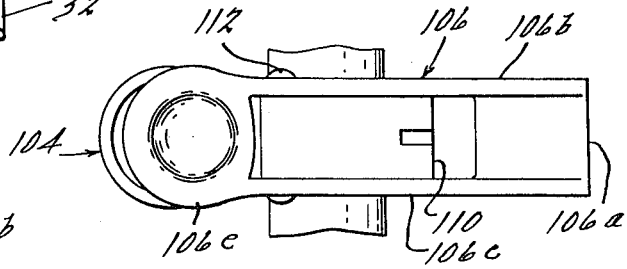
Figure 8:
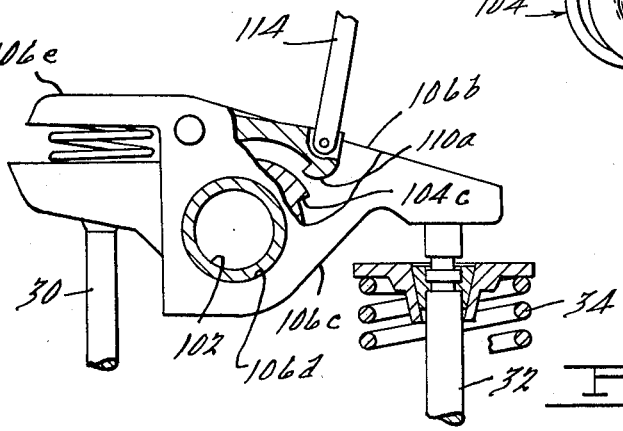

FIGS, 4, 4*a* and 5 are enlarged views of the switching mechanism of FIG. 1;

FIGS. 6–8 are views of a second embodiment of the disabling mechanism.

DESCRIPTION OF FIG. 1

Figure 2:
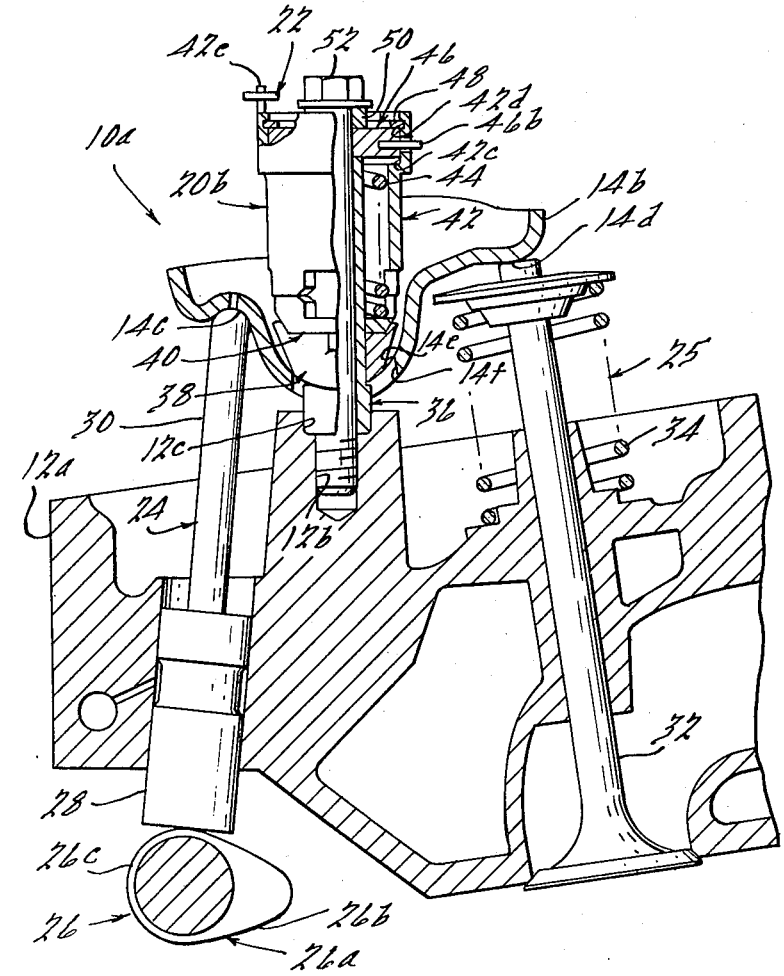
FIGS. 2 and 3 are enlarged views of the disabling mechanism of FIG. 1.
Figure 3:
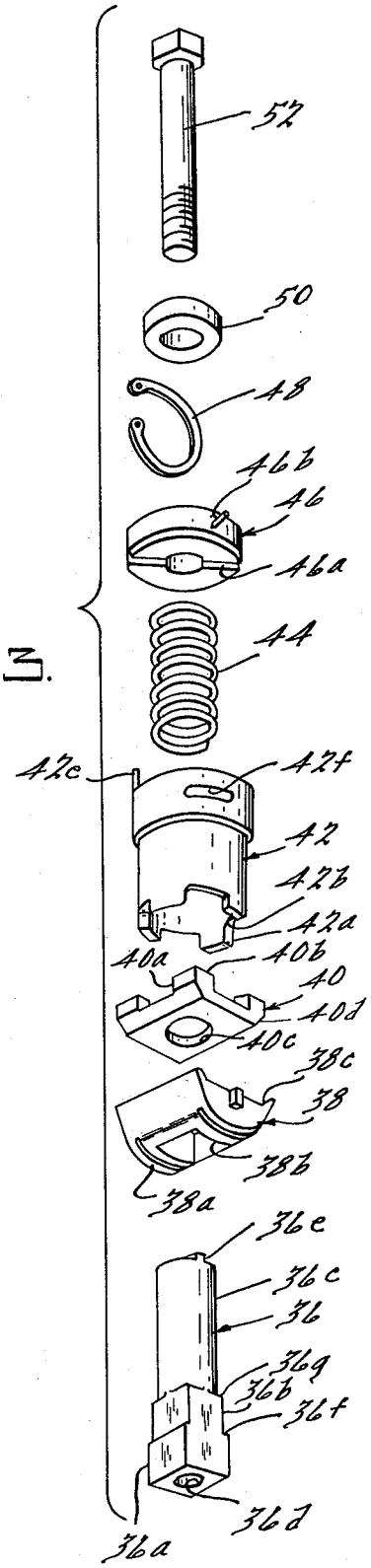
Figure 4:
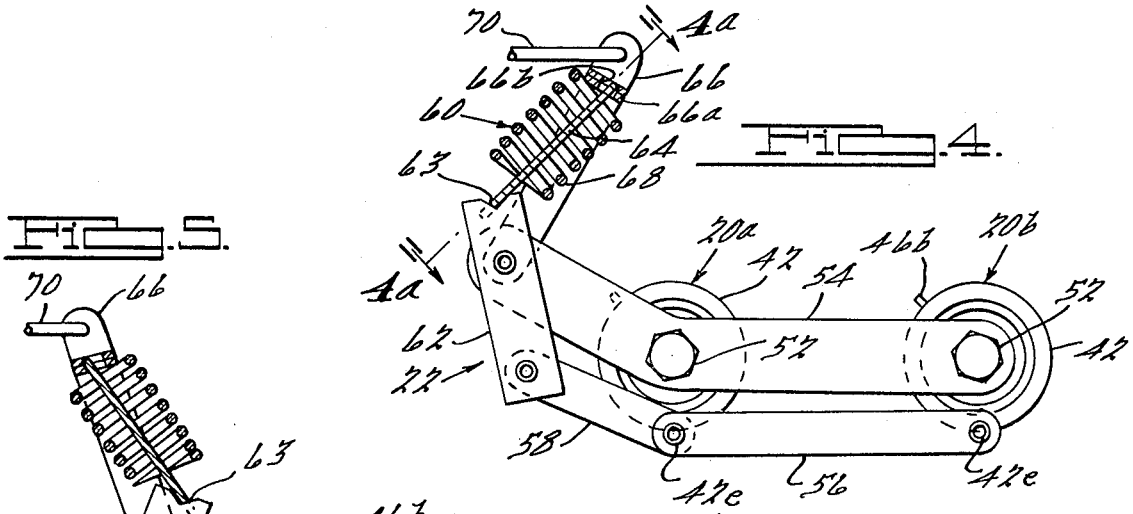
Figure 5:
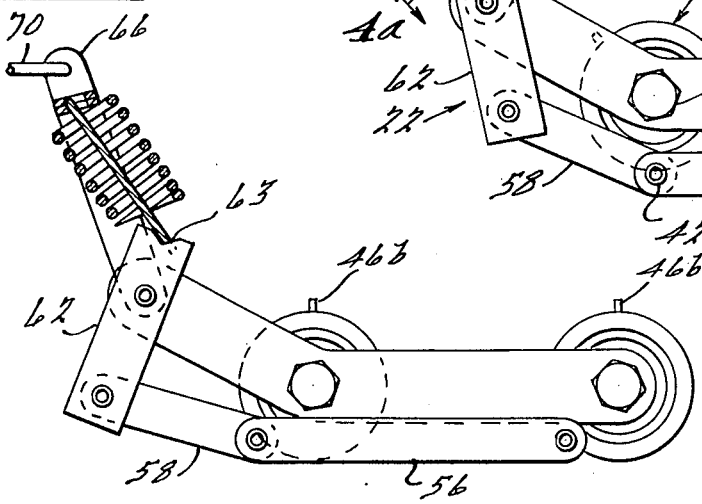
Figure 4A:
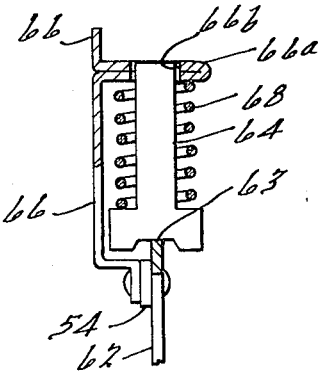

FIG. 1 schematically illustrates a portion of a valve drive train 10 for one bank of a partially shown V-8 engine 12 having a head 12*a*. The illustrated portion of the valve drive train includes two pairs of intake and exhaust valve rocker arms 14 equipped with valve disabling assemblies 16 and two pairs of rocker arms 18 in standard configuration. The other head (not shown) is similarly equipped with two pairs of valve disabling assemblies 16 so that four of the eight cylinders can be selectively deactivated by disabling their respective valves. Each disabling assembly 16 includes two substantially identical valve disabling mechanisms 20*a* and 20*b*, associated, respectively, with rocker arms 14*a* and 14*b* of a rocker arm pair, and a switch mechanism 22 for shifting the mechanisms 20 of one assembly 16 at the same time and independent of the other assemblies. The disabling mechanisms 20 are best seen in FIG. 2 and 3. The switching mechanisms 22 are best seen in FIGS. 4, 4*a* and 5.

DESCRIPTION OF FIGS. 2–5

Referring now to FIG. 2, therein is a cross sectional view in elevation of the head 12*a* looking in the direction of arrows 2—2 in FIG. 1; this view shows a valve actuating drive train 10*a* for one valve of the complete drive train 10. Drive train 10*a* includes a conventional drive assembly 24, rocker arm 14*b* which is also conventional and of the individually pivoted type, one valve disabling mechanism 20*b*, and a conventional driven means 25. Drive means 24 includes a camshaft 26 having a cam 26*a*, a hydraulic lifter 28 and a push rod 30. Cam 26*a* includes a lift portion 26*b* and a dwell portion 26*c*. Driven means 25 includes a valve 32 and a spring 34 which biases the valve to the closed position. Rocker arm 14*b* includes end portions 14*c* and 14*d* which are drivingly connected, respectively, to the push rod and valve, a curved pivot surface 14*e*, and an opening 14*f*. Disabling mechanism 20*b* is installed in drive train 10*a* in lieu of a conventional rocker arm pivot support or fulcrum without modification to other components and may be installed on many engines without modifications to the engine head or support structure. Camshaft 26 and hydraulic lifter 28 are shown out of normal position for illustrative convenience. Disabling assembly 20*b* is the only unconventional component in drive train 10*a*. Other configurations of drive train 10*a* are possible, e.g., hydraulic lifter 28 can be of the mechanical type or camshaft 26 can be of the overhead type.

Referring now to FIGS. 2 and 3, disabling assembly 20*b* includes a support member 36, a fulcrum 38, a latch plate 40, a latch sleeve 42, a preload spring 44, a retainer plate 46, a snap ring 48, a spacer 50, and a mounting bolt 52. Support member 36 includes a rectangular portion 36a at its lower end, a square portion 36b, a round portion 36c, a through bore 36d, and a pair of locating tangs 36e at its upper end. The transition from rectangular to square of portions 36a and 36b defines a pair of parallel stops 36f. The transition from square to round of portions 36b and 36c defines a four cornered stop 36g.

Fulcrum 38 includes a curved pivot surface 38a, a square through passage 38b, and a pair of retaining ribs 38c. Square passage 38b receives square portion 36b snugly enough to prevent relative rotation between the support and the fulcrum but lose enough to allow sliding movement therebetween. Parallel stops 36f provide a means for retaining the fulcrum on the support prior to installation of the disabling assembly on an engine.

Latch plate 40 includes a plurality of teeth or circumferentially spaced projections 40a defining axially facing abutting surfaces 40b, a through bore 40c, and a pair of parallel chamfers 40d. Bore 40c slideably receives round portion 36c. Four cornered stop 36g limits downward movement of the latch plate and parallel ribs 38c embrace chamfers 40d to prevent rotation of the latch relative to the fulcrum.

Sleeve 42 includes a plurality of teeth or circumferentially spaced projections 42a defining axially facing abutting surfaces 42b, a counterbored portion 42c, a snap ring groove 42d, a post portion 42e, and a circumferentially extending slot 42f. Counterbore portion 42c, snap ring groove 42d, and post portion 42e are shown only in FIG. 2.

Retainer plate 46 is rotatively received in counterbore 42c and includes a cross slot 46a which snugly receives tangs 36e to prevent rotation of the retainer plate relative to the support member and a stop pin 46b which projects into slot 42f to limit rotation of the sleeve relative to the retainer plate. When pin 46b abuts one end of slot 42f, abutting surfaces 40b and 42b are axially aligned. When the pin abuts the other end of the slot, abutting surfaces 42b are axially aligned with the spaces between abutting surfaces 40b and vice versa.

Snap ring 48 fixes the axial position of the sleeve relative to the retainer plate. Spacer 50 provides a means for mounting switch mechanism 22.

The disabling mechanism is held together and secured to the support structure of head 12 by bolt 52 which is threaded into a hole 12b. The rectangular end 36a of the support member is snugly received in a slot 12c in the head. When the disabling mechanism is installed, as shown in FIG. 2, the thrust side of the rocker arm bears against the curved surface of fulcrum 38 and latch plate 40 is biased against four cornered stop 36g by the preload of spring 44, which spring reacts against retainer plate 46. The preload force is less than the force of spring 34 and greater than the hydraulic force of lifter 28 when the lifter is on the dwell of the cam. Hence, latch plate 40 is maintained against stop 36g and fulcrum 38 is biased upward against the latch plate by the hydraulic force of the lifter when the drive means is inactive during dwell of the cam; this arrangement establishes the position of the rocker arm and prevents the force of spring 44 acting on drive assembly 24 and collapsing the lifter during a dwell period of the cam. The hydraulic force of the lifter increases rapidly in response to the lifting movement of the cam; this increased force quickly exceeds the preload force and attempts to lift fulcrum 38 and latch plate 40 against the preload of the spring. This lifting or sliding movement of the fulcrum and latch plate is prevented by the abutting surfaces 40b and 42b when the sleeve is in the position shown in FIG. 2. When the surfaces abut, fulcrum 38 is fixed (as is a conventional fulcrum), the drive assembly lifts end 14c a given distance determined by the lift of cam 26a, the rocker arm pivots, and end 14b moves the valve a predetermined opening distance. When sleeve 42 is rotated until pin 46b contacts the other end of slot 42f, abutting surfaces 42b are axially aligned with the spaces between abutting surfaces 40b and vice versa, whereby the increased force of the lifter overcomes the preload of spring 44 and fulcrum 38 slides upward. The axial depth of the spaces fixes the amount of sliding movement of the fulcrum and hence, determines the change or variation in the amount of valve opening in response to the given movement of end 14c of the rocker arm. The depth can be deep enough to completely disable the valve or partially disable the valve.

Spring 44 is designed to freely yield under the increased force of the lifter and provide a counter force which is great enough to keep end 14c in driving contact with push rod 30, i.e., the counter force prevents drive train float. This counter force is an important feature, since float of drive train components causes clashing of the components and allows pump up of the hydraulic lifter if the drive train is so equipped.

The proposed valve disabling system for the V-8 engine 12 includes four disabling assemblies 16, which disable the inlet and exhaust valves of four of the eight cylinders of the engine. The four cylinders are chosen so that the power pulses of the other four cylinders are evenly spaced in terms of crankshaft rotation. The disabling mechanisms 20a and 20b of one disabling assembly 16 may completely disable the intake and exhaust valves of a cylinder, in which case mechanisms 20a and 20b will be identical, or the disabling mechanism 20a may completely disable the inlet valve and mechanism 20b may only partially disable the exhaust valve. Further, mechanism 20b may be dispensed with, in which case only the inlet valves are disabled. The arrangement of partially disabling the exhaust valve is preferred to replace cylinder gases which leak past the piston rings during compression; this arrangement is implemented by shortening the depth of the spaces between the abutting surfaces 40b and/or 42b of mechanism 20b. When so shortened, the exhaust valve will open slightly at the peak lift of the cam.

Referring now to FIG. 4, 4a and 5, therein is shown one switch mechanism 22 for simultaneously rotating the sleeves of a pair of disabling mechanisms 20a and 20b with a controlled force. Switch mechanism 22 includes a support plate 54 secured to the disabling mechanisms by bolts 52, a connecting link 56 pivotally secured at its ends to posts 42e, an intermediate link 58 pivotally secured at one end to post 42e of disabling mechanism 20a, and a spring loaded toggle switch 60. Toggle switch 60 includes toggle links 62 and 64 which define a toggle joint 63, an actuating link 66, and a spring 68. Links 62 and 66 are pivotally connected to support plate 54 and link 62 is also pivotally connected to intermediate link 58. Actuating link 66 includes a reaction plate portion 66a for spring 68. An opening 66b in plate portion 66a allows sliding movement of toggle link 64 during operation of the switch. A rod 70 pivotally moves the actuating link between its off position, as shown in FIG. 4 and its on position, as shown in FIG. 5.

Operation of spring loaded toggle switches such as toggle 60 is well known. When the actuating link is moved from off to on or vice versa the biasing force of spring 68 on the toggle joint is reversed. This biasing force is effective to pivot link 62 and rotate sleeves 42 of disabling mechanisms 20*a* and 20*b* via the links 58 and 56 only during an inactive period of the rockers, i.e., only when both lifters associated with disabling mechanism 20*a* and 20*b* are on the dwell of their respective cams. Therefore, movement of the actuating link from the off position of FIG. 4 will not effect a movement of links 62, 58 and 56 and rotation of sleeves 42 from the positions of FIG. 4 to the positions of FIG. 5 until the rocker arms associated with disabling mechanisms are inactive. The converse is also true. Hence, the disabling assemblies 16 may be switched on or off while the engine is running without fear of clashing of components in the disabling system or the drive train system.

Switching assembly 22 is merely one example of a device for applying a controlled force for simultaneously rotating the sleeves of a pair of disabling mechanisms. The controlled force could be applied by a fluid motor such as a vacuum motor. Simultaneous rotating of the sleeves may not be desirable on some installations, in which case each disabling mechanism may be provided with a switching mechanism.

DESCRIPTION OF FIGS. 6–8

FIGS. 6–8 show a valve disabling mechanism 100 which defines a rocker arm for an engine having a rocker shaft 102 in lieu of the individually pivoted rocker arms, as shown in FIGS. 1 and 2. Disabling mechanisms 100 are substituted in lieu of conventional shaft type rocker arms. Disabling mechanism 100, though substantially different in structure from mechanism 20, still provides the same basic features of mechanism 20; when off, the valve drive train functions in a conventional manner; when on, the predetermined opening distance of valve 32 is varied (even though an end portion 104*a* of a two member rocker arm 104 and 106 associated with drive means 24 continues to move the given distance), a spring 108 prevents drive train float and hydraulic pump up of the lifter, and a stop 106*f* prevents collapsing of the hydraulic lifter by limiting downward movement of the rocker arm end portion 104*a* during the dwell period of the cam.

Disabling mechanism 100 includes the two member rocker arm 104 and 106, a pivotal latch 110, and the spring 108. Rocker arm member 104 includes end portion 104*a*, a journal portion 104*b* which is pivotally supported by shaft 102, and a latch notch 104*c*. Rocker arm member 106 includes an end portion 106*a*, a pair of substantially parallel side wall portions 106*b* and 106*c*, a spring reaction portion 106*e*, a pair of axially aligned holes (such as hole 106*d*) for pivotally journaling rocker arm member 106 on shaft 102, and the stop 106*f*. Latch 110 is pivotally secured at one end to the side walls by a pin 112 and has a latch hook 110*a* at the other end which is selectively engageable and disengageable with latch notch 104*c*, by a link 114. Latch hook 110*a* when engaged, as in FIG. 6, prevents rotation of rocker arm piece 104 relative to rocker arm piece 106, whereby the rocker arm functions in a conventional manner and valve 32 is moved the predetermined opening distance in response to end portion 104*a* moving the given distance. When the latch hook is disengaged, as in FIG. 8, spring 108 freely collapses under the lifting force of the drive means, thereby disabling valve 32. Partial disablement of the valve may be provided by a second latch notch (not shown) which will engage latch hook 112*a* after partial rotation of rocker arm piece 104 or end portion 104*a* can be made to engage reaction portion 106*e* after a specified distance of travel. Link 114 may be moved by a device such as switch mechanism 22.

The preferred embodiments of the invention have been disclosed for illustrative purposes. Many variations and modifications of the preferred embodiments are believed to be within the spirit of the invention. The following claims are intended to cover the inventive portion of the preferred embodiment and the variations and the modifications within the spirit of the invention.

What is claimed is:

1. A device for changing the fulcrum of an engine valve rocker arm to selectively disable and enable the valve, said device comprising:

support means adapted for attachment to the engine;

fulcrum means slideably mounted on said support means, said fulcrum means defining a pivot surface adapted to contact said valve rocker arm;

first means mounted for sliding movement with said fulcrum means and retained against rotation relative to said support means, said first means defining a first abutting surface;

second means rotatably mounted on said support member and retained against sliding movement relative to said support means, said second means defining a second abutting surface for contacting said first abutting surface and adapted to react engine valve drive train forces which effect normal opening of the engine valve; and actuation means selectively operative to apply a force to rotate said second means to a valve enabling position drivingly connecting said abutting surfaces for effecting normal valve opening and closing in response to engine valve train driving forces and selectively operative to apply a force to rotate said second means to a valve disabling position drivingly disconnecting said abutting surfaces for effecting disablement of said valve by allowing movement of said surfaces relative to each other in response to the valve train driving forces.

2. The device of claim 1, wherein said actuation force for rotating said second member to said valve disabling position is effective to move said second member upon relaxation of said valve train driving forces.

3. The device of claim 1, further including:

means for biasing said first surface counter to said valve train driving forces and operative when said second member is in said valve disabling position to resiliently absorb said relative movement of said surfaces for preventing clashing of components in the engine valve drive train.

4. The device of claim 3, further including:

stop means for contacting said fulcrum means and preventing transmittal of forces from said biasing means to said valve drive train when said valve train driving forces are relaxed.

5. A device for changing the fulcrum of an engine valve rocker arm to selectively disable and enable a valve biased closed by a valve spring and normally opened in response to valve drive train forces acting through the rocker arm, said device comprising:

elongated support means adapted for fixed attachment to the engine;

fulcrum means mounted for sliding movement along the longitudinal axis of said support means, said fulcrum means defining a pivot surface adapted to contact the rocker arm;

first means mounted for sliding movement with said fulcrum means and retained against rotation about the longitudinal axis of said support means, said first means defining a first abutting surface;

second means mounted for rotation about the longitudinal axis of said support means and retained against sliding movement along the longitudinal axis of said support member, said second means defining a second abutting surface for contacting said first abutting surface and adapted to react periodic valve drive train forces which effect normal opening of the engine valve; and positioning means operative to rotate said second means to a valve enabling position drivingly connecting said abutting surfaces for preventing sliding movement of said fulcrum and effecting normal opening of the valve in response to the periodic valve drive train forces and operative to rotate said second means to a valve disabling position drivingly disconnecting said abutting surfaces for allowing sliding movement of said fulcrum and preventing normal opening of the valve in response to the periodic valve drive train forces.

6. The device of claim 5, further including:

resilient means reacting against said support means and adapted to bias said fulcrum means against the rocker arm with a force inferior to the force of the valve spring and valve drive train forces, said resilient means operative to resiliently absorb sliding movement of said fulcrum means and prevent clashing of components in the valve drive train when said second means is in said valve disabling position.

7. The device of claim 6, further including:

stop means for positioning said fulcrum means in the biased direction.

8. The device of claim 7, wherein said positioning means includes:

actuation means selectively operative to apply an actuating force effective to move said second means between said enabling and disabling positions when the valve drive train forces are relaxed.

9. In an expansible combustion chamber engine of the type including at least one valve controlling fluid flow to or from the chamber, a valve drivetrain effecting normal opening of the valve in response to periodic forces, and a device for enabling and disabling the normal opening while the engine is running, an improved device comprising:

means slaved for movement with portions of the drivetrain; and latch means mounted for rotational movement between enabling and disabling positions while the engine is running, said latch means operative when rotated to the enabling position to effect a driving connection between said means slaved and the valve, whereby normal valve opening is effected, and said latch means operative when rotated to the disabling position to effect a lost motion connection between the means slaved and the valve, whereby the valve is disabled.

10. The improved device of claim 9, further including:

resilient means biasing said means slaved with a force inferior to said periodic force and operative to prevent clashing of said means slaved when said latch means is in the disabling position.

11. The improved device of claim 10 further including:

stop means limiting the distance said resilient means biases said means slaved for preventing transmittal of the biasing force to the valve train when the periodic forces are relaxed.

12. In an expansible combustion chamber engine of the type including at least one valve controlling fluid flow to or from the chamber, a valve drivetrain effecting normal opening of the valve in response to periodic forces, and a device for enabling and disabling the normal opening while the engine is running, an improved device comprising:

means slaved for movement with portions of the drivetrain;

latch means moveable between enabling and disabling positions while the engine is running, said latch means operative in the enabling position to effect a driving connection between said means slaved and the valve, whereby normal valve opening is effected, and said latch means operative in said disabling position to effect a lost motion connection between the means slaved and the valve, whereby the valve is disabled;

resilient means biasing said means slaved with a force inferior to said periodic forces and operative to prevent clashing of said means slaved when said latch means is in the disabling position; and stop means limiting the distance said resilient means biases said means slaved for preventing transmittal of the biasing force to the valve train when the periodic forces are relaxed.

13. The engine of claim 11 or 12, wherein said valve drivetrain includes a hydraulic lash adjuster, said adjuster operative to maintain zero lash between said means slaved and said portions of the drivetrain, and said stop means operative to prevent collapse of said adjuster by said biasing force when said periodic forces are relaxed.

14. In a machine having improved means varying the amount of valve opening in a valve actuating drivetrain of the type having a rocker arm, and a valve biased to the closed position by a spring force and operatively associated with one end of the rocker arm and normally moved a predetermined opening distance in response to a drive means applying a periodic force which normally effects pivotal movement about the fulcrum of the rocker arm by moving the other end of the rocker arm a given distance, the improved varying means comprising;

resilient means for biasing at least a portion of said rocker arm in a direction counter to said drive means force with a force inferior to said periodic drive means force and said valve spring force; and stop means for limiting the distance said resilient means biases said at least a portion of said rocker arm in a direction counter to said drive means force; and means associated with said rocker arm and moveable between first and second positions, said means associated operative when in said first position to prevent yielding of said resilient means under the force of said drive means to effect normal pivotal movement of the rocker arm in response to said drive means moving said other end of said rocker arm said given distance, and said means associated operative when in said second position to allow yielding of said resilient means under the force of said drive means for effecting a change in said pivotal movement when said drive means moves said other end of said rocker arm said given distance and for providing a force in said drivetrain to maintain driving contact between said drive means and said other end of said rocker arm.

15. In a machine having improved means varying the amount of valve opening in a valve actuating drivetrain of the type having a rocker arm, and a valve biased to the closed position by a spring force and operatively associated with one end of the rocker arm and normally moved a predetermined opening distance in response to a drive means applying a periodic force which normally effects a pivotal movement about the fulcrum of the rocker arm by moving the other end of the rocker arm a given distance, the drive means including a hydraulic lifter and a camshaft driven cam having a lift portion and a dwell portion, the improved varying means comprising:

resilient means for biasing at least a portion of said rocker arm in a direction counter to said drive means force with a force inferior to said periodic drive means force and said valve spring force;

means associated with said rocker arm and moveable between first and second positions, said means associated operative when in said first position to prevent yielding of said resilient means under the force of said drive means to effect normal pivotal movement of the rocker arm in response to said drive means moving said other end of said rocker arm said given distance, and said means associated operative when in said second position to allow yielding of said resilient means under the force of said drive means for effecting a change in said pivotal movement when said drive means moves said other end of said rocker arm said given distance and for providing a force in said drivetrain to maintain driving contact between said drive means and said other end of said rocker arm; and stop means for limiting the distance said resilient means biases said at least a portion of said rocker arm in a direction counter to said drive means force, thereby preventing collapse of said hydraulic lifter during the dwell period of said cam.

16. In a machine having improved means varying the amount of valve opening in a valve actuating drivetrain of the type having a rocker arm, and a valve biased to the closed position by a spring force and operatively associated with one end of the rocker arm and normally moved a predetermined opening distance in response to a drive means applying a periodic force which normally effects a pivotal movement about the fulcrum of the rocker arm by moving the other end of the rocker arm a given distance, the improved varying means comprising:

a shaft providing a rigid pivotal support for said rocker arm;

first and second members respectively defining said one end and said other end of said rocker arm and said members supported by said shaft for limited rotation relative to each other;

resilient means for biasing at least a portion of said rocker arm in a direction counter to said drive means force with a force inferior to said periodic drive means force and said valve spring force; and means associated with said first and second members and moveable between first and second positions, said means associated operative when in said first position to prevent said relative rotation and yielding of said resilient means under the force of said drive means to effect normal pivotal movement of the rocker arm in response to said drive means moving said other end of said rocker arm said given distance, and said means associated operative when in said second position to allow said relative rotation and yielding of said resilient means under the force of said drive means for effecting a change in said pivotal movement when said drive means moves said other end of said rocker arm said given distance and for providing a force in said drivetrain to maintain driving contact between said drive means and said other end of said rocker arm.

17. The valve drivetrain of claim 16, wherein said resilient means biases said other end of said rocker arm toward said drive means and reacts against said first member, thereby providing a biasing force tending to rotate said first and second members relative to each other when said associated means is in said second position.

18. The valve drivetrain of claim 17, wherein said varying means further includes:

stop means for limiting the amount of relative rotation between said first and second members in response to said resilient means.

19. The valve drivetrain of claim 16, wherein said drive means includes a cam driven by a camshaft and a hydraulic valve lifter and said drive means force diminishes to a force inferior to said resilient means force when said cam is in a dwell position, and wherein said varying means further includes:

stop means for limiting the distance said resilient means biases said at least a portion of said rocker arm in a direction counter to said drive means force, thereby preventing collapsing of said hydraulic lifter during the dwell period of said cam.

20. In a machine having improved means varying the amount of valve opening in a valve actuating drivetrain of the type including a rocker arm having an opening extending therethrough, a valve biased to the closed position by a spring force and operatively associated with one end of the rocker arm and normally moved a predetermined opening distance in response to a drive means applying a force which moves the other end of the rocker arm a given distance, the improved varying means comprising:

a support member fixed at one end to a support structure and extending through the opening transverse to the normal fulcrum of the rocker arm;

fulcrum means slideably disposed about said support member on the thrust side of said rocker arm and presenting a curved surface for the normal pivoting of the rocker arm; and latch means including first and second sets of circumferentially spaced abutting surfaces, said first set of surfaces moveable between first and second positions and operative when in said first position to abut said second set of abutting surfaces and to prevent sliding movement of said fulcrum means, whereby said valve is moved said predetermined opening distance in response to the other end of the rocker arm being moved said given distance, and said first set of surfaces operative when in said second position to mesh with spaces between said second set of abutting surfaces to allow sliding movement of said fulcrum means, whereby said predetermined opening distance is varied.

21. The drivetrain of claim 20 wherein nonmovement of said rocker arm by said drive means constitutes an inactive period of said rocker arm, and wherein said varying means further include:

means operative to apply a force effective to move said moveable means between said first and second positions only when said rocker arm is inactive.

22. In a machine having improved means varying the amount of valve opening in a valve actuating drivetrain of the type including a rocker arm having an opening extending therethrough, a valve biased to the closed position by a spring force and operatively associated with one end of the rocker arm and normally moved a predetermined opening distance in response to a drive means applying a force which moves the other end of the rocker arm a given distance from an inactive position during nonmovement of the rocker arm by the drive means, the improved varying means comprising:

a support member fixed at one end to a support structure and extending through the opening transverse to the normal fulcrum of the rocker arm;

fulcrum means slideably disposed about said support member on the thrust side of said rocker arm and presenting a curved surface for the normal pivoting of the rocker arm;

latch means including means moveable between first and second positions, said latch means operative when in said first position to prevent sliding movement of said fulcrum means, whereby said valve is moved said predetermined opening distance in response to the other end of the rocker arm being moved said given distance, and said latch means operative when in said second position to allow sliding movement of said fulcrum means, whereby said predetermined opening distance is varied;

resilient means biasing said fulcrum means into engagement with said rocker arm with a force inferior to the forces of said spring and drive means and operative when said moveable means is in said second position to provide a force for maintaining driving contact between said drive means and said other end of said rocker arm; and stop means for limiting the distance said resilient means biases said fulcrum means toward said rocker arm to prevent the force of said resilient means being transmitted to said drive means and to establish the position of said fulcrum means when the rocker arm is inactive.

23. In a machine having improved means varying the amount of valve opening in a valve actuating drivetrain of the type including a rocker arm having an opening extending therethrough, a valve biased to the closed position by a spring force and operatively associated with one end of the rocker arm and normally moved a predetermined opening distance in response to drive means applying a force which moves the other end of the rocker arm a given distance, the drive means including a hydraulic lifter and a camshaft driven cam having a lift portion and a dwell portion, the improved varying means comprising:

a support member fixed at one end to a support structure and extending through the opening transverse to the normal fulcrum of the rocker arm;

fulcrum means slideably disposed about said support member on the thrust side of said rocker arm and presenting a curved surface for the normal pivoting of the rocker arm;

latch means including means moveable between first and second positions, said latch means operative when in said first position to prevent sliding movement of said fulcrum means, whereby said valve is moved said predetermined opening distance in response to the other end of the rocker arm being moved said given distance, and said latch means operative when in said second position to allow sliding movement of said fulcrum means, whereby said predetermined opening distance is varied;

resilient means biasing said fulcrum means into engagement with said rocker arm with a force inferior to the forces of said spring and cam lift portion and operative when said moveable means is in said second position to provide a force for maintaining driving contact between said drive means and said other end of said rocker arm; and stop means for limiting the distance said resilient means biases said fulcrum means toward said rocker arm to prevent collapse of said hydraulic lifter by the force of said resilient means and to establish the position of said fulcrum means during the dwell period of said cam.

24. In a multicylinder internal combustion engine having improved valve disabling means associated with at least the inlet valve of every other cylinder in the engine firing order; the engine being of the type including an inlet and an exhaust valve for each cylinder, a spring for biasing each valve ot the closed position, and a valve drivetrain for operating each valve; each drivetrain including an independently pivoted rocker arm having one end in driving contact with the respective valve and the other end in driving contact with a drive means which includes a cam driven by a camshaft; the improved valve diabling means comprising:

a support member fixed at one end to a support structure;

fulcrum means slideably disposed about said support member on the thrust side of the pivot surface of the rocker arm and presenting a curved surface thereto;

latch means including moveable means operative when in a first position to prevent sliding movement of said fulcrum means, thereby effecting normal pivoting of said rocker arm and opening of the respective valve in response to said drive means moving said other end of the rocker arm, and operative when in a second position to allow sliding movement of said fulcrum means, thereby varying the pivoting of the rocker arm and disabling the respective valve;

resilient means for biasing said slideable fulcrum means toward engagement with said rocker arm with a force inferior to the lifting force of said drive means and inferior to the bias force of said valve spring, said resilient means and operative when said moveable means is in said second position to provide a force for maintaining driving contact between said drive means and said other end of said rocker arm; and stop means for limiting the distance said resilient means biases said fulcrum means toward said rocker arm to prevent the force of said resilient means being transmitted to said drive means when said cam is in a dwell position.

25. In a multicylinder internal combustion engine having improved valve disabling means associated with at least the inlet valve of every other cylinder in the engine firing order; the engine being of the type including an inlet and an exhaust valve for each cylinder, a spring for biasing each valve to the closed position, and a valve drivetrain for operating each valve; each drivetrain including an independently pivoted rocker arm having one end in driving contact with the respective valve and the other end in driving contract with a drive means which includes a cam driven by a camshaft; the improved valve disabling means comprising:

a support member fixed at one end to a support structure;

fulcrum means slideably disposed about said support member on the thrust side of the pivot surface of the rocker arm and presenting a curved surface thereto;

latch means including first and second sets of circumferentially spaced abutting surfaces relatively moveable between first and second positions, said first set of surfaces operative when in said first relative position to abut said second set of surfaces and prevent sliding movement of said fulcrum means, thereby effecting normal pivoting of said rocker arm and opening of the respective valve in response to said drive means moving said other end of the rocker arm, and said first set of surfaces operative when in said second relative position to mesh with spaces between said second set of surfaces and allow sliding movement of said fulcrum means, thereby varying the pivoting of the rocker arm and disabling the respective valve; and resilient means for biasing said slideable fulcrum means toward engagement with said rocker arm with a force inferior to the lifting force of said drive means and inferior to the bias force of said valve spring, said resilient means operative when said moveable means is in said second position to provide a force for maintaining driving contact between said drive means and said other end of said rocker arm.

26. The engine of claim 25, wherein said disabling means further includes;

stop means for limiting the distance said resilient means biases said fulcrum means toward said rocker arm to prevent the force of said resilient means being transmitted to said drive means when said cam is in a dwell position.

27. The engine of claim 26, wherein said disabling means further includes;

actuation means operative to apply a force effective to move said moveable means between said first and second positions only when said cam is in the dwell position.

28. A device for changing the fulcrum of an engine valve actuator to selectively disable and enable the engine valve, said device comprising;

support means adapted for attachment to the engine;

fulcrum means slideably and nonrotatably mounted on said support means, said fulcrum means defining a pivot surface for contacting the engine valve actuator;

actuator means rotatably received on said support means;

positioning means registrable with said actuator means and operative to latch said fulcrum mans in first second rotational position on said support means in response to selected rotational movement of said actuator means;

means biasing said fulcrum positioning means away from contact with said actuator means; and means retaining said actuator means on said support means, wherein said fulcrum means in said first latched position is adapted for enabling the engine valve actuator and in said second position is adapted for disabling the engine valve actuator.

29. The device as set forth in claim 28, wherein said actuator means includes:

a sleeve with said support means received centrally therethrough in a manner permitting relative rotation therebetween, said sleeve having portions thereof formed to a configuration for selective registration with associated components of said positioning means; and said positioning means being received on said support means in sliding and nonrotating relationship with said fulcrum means.

30. The device as set forth in claim 28, wherein said support means includes means engaging said actuator means for limiting rotation of said actuator means.

31. The device as set forth in claim 28, wherein said support means includes means defining polygonal surfaces engaging said fulcrum means and preventing relative rotation of said fulcrum means about said support means.

32. The device as set forth in claim 29, wherein said means biasing includes spring means disposed within said sleeve means for biasing said positioning and fulcrum means away from said actuator means.

33. The device as set forth in claim 28, wherein said support means includes elongated means defining an aperture longitudinally therethrough and adapted for receiving fastening means therethrough.

34. A device for selectively disabling and enabling normal opening of valves of an internal combustion engine while the engine is running, said device comprising:

a support member adapted for attachment to the engine;

first and second means adapted for incorporation into the engine valve drivetrain, said first means including fulcrum means slidably mounted on said support member and defining a pivot surface adapted for contacting a pivot portion of a rocker arm of the valve drivetrain, said fulcrum means including first abutting means mounted for sliding movement with said fulcrum means and retained against rotation relative to said support member, and said second means rotatably mounted on said support member and retained thereon against sliding movement relative to said support member and including second abutting means for contacting said first abutting means and adapted to react valve train driving forces which effect normal opening of the engine valves;

actuation means connected to said second means and selectively operative to apply a force directly to said second means to rotate said second abutting means into driving interconnection with said first abutting means to effect normal valve opening and closing and selectively operative to apply a force directly to said second means to rotate said second abutting means out of driving interconnection with said first abutting means to effect a disabling of the valves by allowing relative movement of said abutting means in response to said valve train driving forces; and means for biasing said first abutting means counter to said valve train driving forces and operative when said actuation means moves said second abutting means out of driving interconnection to resiliently absorb said relative movement of said abutting means for preventing clashing of components in said valve drivetrain.

35. The device of claim 34, further including:

stop means contacting said fulcrum means for preventing transmittal of forces from said biasing means to said valve train when said valve train driving forces are relaxed.

36. The device of claim 34, wherein:

said first abutting means defines a first set of abutting surfaces circumferentially spaced about said support member; and said second abutting means defines a second set of abutting surfaces circumferentially spaced about said support member, said second set of abutting surfaces operative to contact said first set of abutting surfaces when said second means is in said valve enabling position and operative to mesh with the spaces separating said first set of abutting surfaces when said second means is in said valve disabling position.

* * * * *